US005085673A

United States Patent [19]

Bentley et al.

[11] Patent Number: 5,085,673

[45] Date of Patent: Feb. 4, 1992

[54] COMPACT AIR SCRUBBER

[75] Inventors: Bill F. Bentley, Santa Fe; James H. Jett; John C. Martin, both of Los Alamos; George C. Saunders, Espanola, all of N. Mex.

[73] Assignee: The United States of America as represented by the United States Department of Energy, Washington, D.C.

[21] Appl. No.: 671,330

[22] Filed: Mar. 19, 1991

[51] Int. Cl.[5] ..... B03C 3/00

[52] U.S. Cl. ..... 55/10; 55/15; 55/257.3; 55/270; 55/277

[58] Field of Search ..... 55/10, 15, 257.3, 277, 55/270

[56] References Cited

U.S. PATENT DOCUMENTS

| | | | |
|---|---|---|---|
| 2,620,894 | 12/1952 | Peterson | 55/15 |
| 3,960,523 | 6/1976 | Ryan | 55/84 |
| 4,011,157 | 3/1977 | Pinnebaker et al. | 55/15 |
| 4,125,589 | 11/1978 | deVries | 423/245 |
| 4,238,461 | 12/1980 | DeVries | 423/210 |
| 4,479,379 | 10/1984 | Tarcy | 73/23 |
| 4,595,399 | 6/1986 | Collins et al. | 55/255 |
| 4,863,495 | 9/1989 | Rafson | 55/85 |
| 4,968,336 | 11/1990 | Reimanis et al. | 55/257.3 |

OTHER PUBLICATIONS

Lee M. Buchanan et al., "Simple Liquid Scrubber for Large-Volume Air Sampling", 6 Applied Microbiology, vol. 23, pp. 1140–1144 (Jun. 1972).

George C. Saunders et al., "Pulsed Laser Fluorometry for Environmental Monitoring". This paper, which discusses the invention, is to be published in a conference proceedings volume resulting from the U.S.-Israel Research Conference on Advances in Applied Biotechnology, in Haifa, Israel on Jun. 24–29, 1990.

*Primary Examiner*—Bernard Nozick

*Attorney, Agent, or Firm*—Richard J. Cordovano; Paul D. Gaetjens; William R. Moser

[57] ABSTRACT

Method and apparatus for removing material from a gas. A mist created by a piezoelectric ultrasonic transducer is contacted with the gas and both gas and mist are passed through baffled separators. Liquid effluent from the separators contains solid material removed from the gas and gaseous material which reacted with the liquid or was absorbed by the liquid. The invention is useful for collecting a sample of material in a gas, such as a vapor in the atmosphere, and in cleaning a gas. A relatively concentrated solution of a material present in a gas in a very small concentration can be obtained.

19 Claims, 2 Drawing Sheets

COMPACT AIR SCRUBBER

This invention is the result of a contract with the Department of Energy (Contract No. W-7405-ENG-36).

BACKGROUND OF THE INVENTION

This invention relates to environmental sampling, process sampling, and air cleaning.

There are numerous applications for this invention. In combination with a detection system, it can be used to monitor the atmosphere for both particulate and chemical pollutants. Since very small amounts of a material in a gas can be concentrated by passing a large volume of the gas through the inventive apparatus, explosives and narcotics can be detected in a room even after they have been removed from the room. Virtually every solid material has a vapor pressure, that is, has molecules of the material present in the form of a vapor in the atmosphere adjacent to the solid material. These molecules are collected by means of the invention. The inventive apparatus can be used to monitor a smokestack: a small portion of the stack gas can be passed through the apparatus, where sulfur oxides can be removed from the gas by means of a liquid such as sodium hydroxide. Continuous analysis of the liquid then provides an indication of the amount of sulfur oxides discharged to the atmosphere by the stack. Other applications of the invention include automobile emissions, atmospheric pollen counts and other micro-organisms in the atmosphere, below ground mine atmospheres, and monitoring gases exhaled by humans, such as the amount of an anesthetic gas in a persons exhalations.

In addition to the above applications, which may be categorized as sampling applications, the invention is useful in cleaning gases, that is removing a contaminant material from a gas. For example, the exhaust from a laboratory hood may be passed through the inventive apparatus in order to remove a material which should not be discharged into the atmosphere.

SUMMARY OF THE INVENTION

This invention is a method and apparatus for removing material from a gas. A mist created by a piezoelectric ultrasonic transducer is contacted with the gas and both gas and mist are passed through baffled separators. Liquid effluent from the separators contains solid material removed from the gas and gaseous material which reacted with the liquid or was absorbed by the liquid. The invention is useful for collecting a sample of material in a gas, such as a vapor in the atmosphere, and in scrubbing, or cleaning, a gas. A relatively concentrated solution of a material present in a gas in a very small concentration can be obtained.

DETAILED DESCRIPTION OF THE INVENTION

Figures 1, 2:
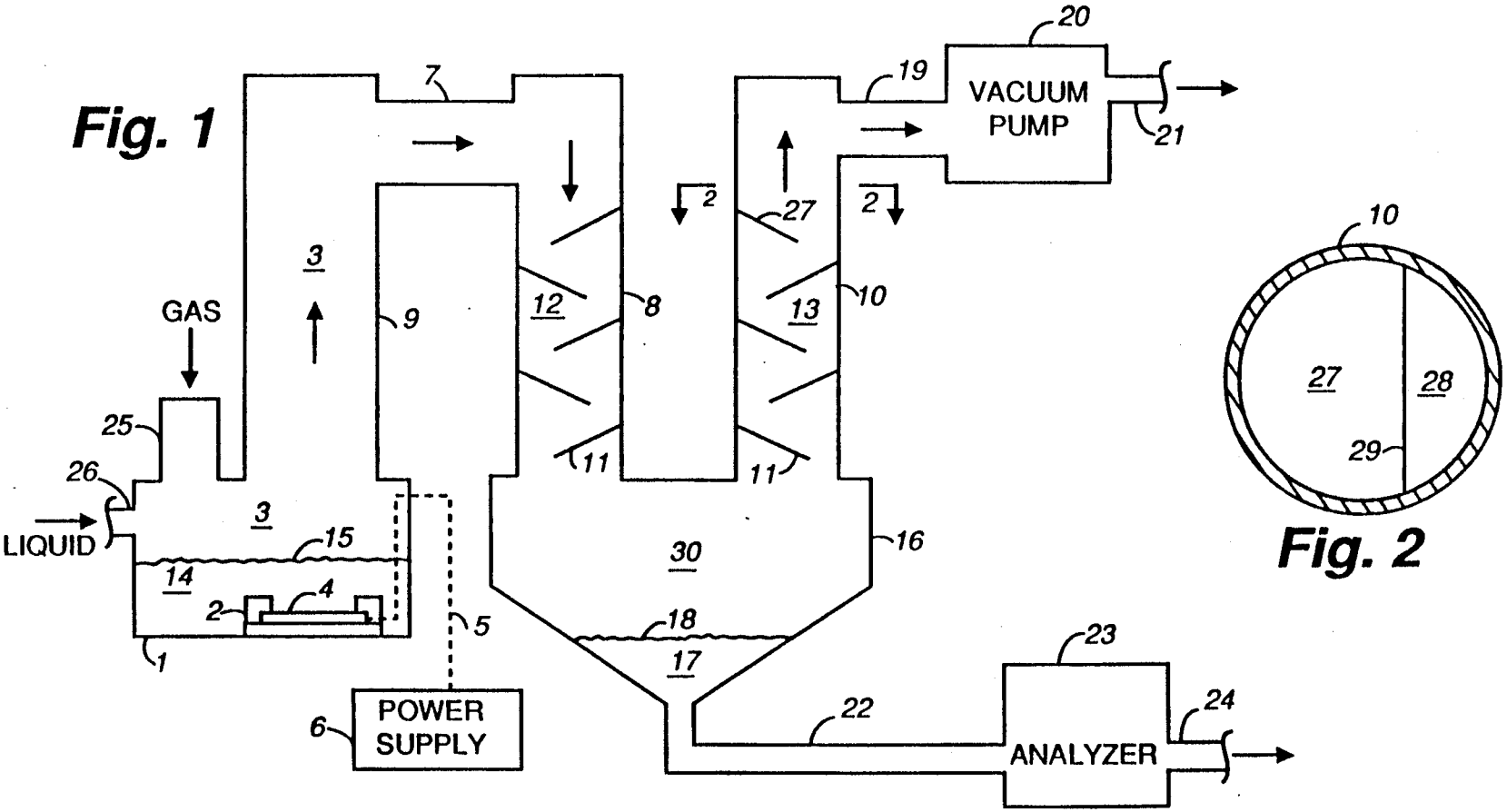
FIG. 1 is a schematic representation of an embodiment of the inventive apparatus.
FIG. 2 is a section view of a baffled separator taken as shown by the section arrows of FIG. 1.

An embodiment of the invention similar to that of FIG. 1 was constructed and tested. Referring to FIG. 1, liquid is added to reservoir 1 by means of nozzle 26. The flow of liquid entering the reservoir may be controlled by a level control valve (not shown) which operates in response to the location of liquid level 15 in reservoir 1. Piezoelectric ultrasonic transducer 4, which is mounted in housing 2, is located in reservoir 1. Power supply 6 provides electrical power to transducer 4 by means of cable 5. Parameters such as amplitude and frequency are adjustable at power supply 6. Gas enters the space above the liquid level through nozzle 25 and mixes with mist generated by transducer 4 which is rising from the surface of the liquid. Mixing zone 3 includes a space above liquid level 15 in reservoir 1 and a cylindrical pipe 2 having an inside diameter of 2 inches.

Gas and mist flow from pipe 9 through connecting pipe 7 to the upper portion of separation zone 12, which is contained in cylindrical pipe 8. Pipe 8 has an inside diameter of 1.5 inches. Separation zone 12 contains 8 baffles, though only 4 baffles are depicted in FIG. 1 for drawing convenience. Reference no. 11 denotes a typical baffle. The baffles are flat plates which are angled downward The section of pipe 8 containing the baffles is about 6 inches long and it can be seen that the length of pipe 9 below crossover pipe 7 is also about 6 inches. Separation zone 13, which is within pipe 10, is identical to separation zone 12, having an inside diameter of 1.5 inches, a length of about 6 inches, and 8 baffles.

FIG. 2 is a section view of pipe 10 taken as shown by the section arrows labeled 2 in FIG. 1. Baffle 27 blocks much of the area of pipe 10, as shown by the location of baffle edge 29. Gas flowing upward in mixing zone 13 passes through the space denoted by reference no. 28. The area, in a horizontal plane, of the inside of pipe 10 which is blocked by each baffle is about 75% of the total horizontal area of the inside of the pipe. The horizontal area which is blocked by a baffle may range from about 50% to about 80%. The downward facing angle formed by the baffle and wall of the separation zone is 30°. This angle may vary from about 20° to about 60°.

Mist and gas flow downward through separation zone 12 and pass into space 30 of reservoir 16. The gaseous stream then flows upward through separation zone 13 and exits pipe 10 through pipe 19. Vacuum pump 20 is used to cause the gas to flow into nozzle 25 and through the system to pipe 19. Other means, such as a fan or blower, may also be used. The gases discharge from the vacuum pump through nozzle 21 to the atmosphere or other appropriate location. Certain gaseous components of the gas entering through nozzle 25 will react with the liquid or be absorbed by the liquid as the gas and mist pass through mixing zone 3. These are the materials which, along with particulate material, if any, are to be detected and measured and/or removed from the gas. As the gas and mist pass through separation zone 12, mist droplets agglomerate to sizes too large to be carried by the gas stream through zone 12 and space 30 and into separation zone 13. These droplets of liquid collect in the reservoir 16. The level of liquid 17 in the reservoir is shown by reference no. 18. If there is particulate matter in the gas, it also collects in reservoir 16. As the gaseous stream flows through separation zone 13, additional liquid and particulate matter disengage from the stream and flow down through the mixing zone into reservoir 16.

The liquid and particulate matter, if any, flow out of reservoir 16 to analyzing zone 23 by means of tubing 22. The analyzing zone may contain any type of analysis equipment which is appropriate to obtain the information desired from the stream of liquid and material removed from the gas. In the experimental apparatus which was built and tested, the liquid stream from reservoir 16 flowed through a cuvette and a pulsed dye laser fluorometer was used to measure fluorescence of the liquid. The liquid exiting the analyzing zone through nozzle 24 is passed to appropriate means of disposal. In some applications, the liquid may be cleaned of the material added and returned to the first reservoir for re-use.

Figure 3:
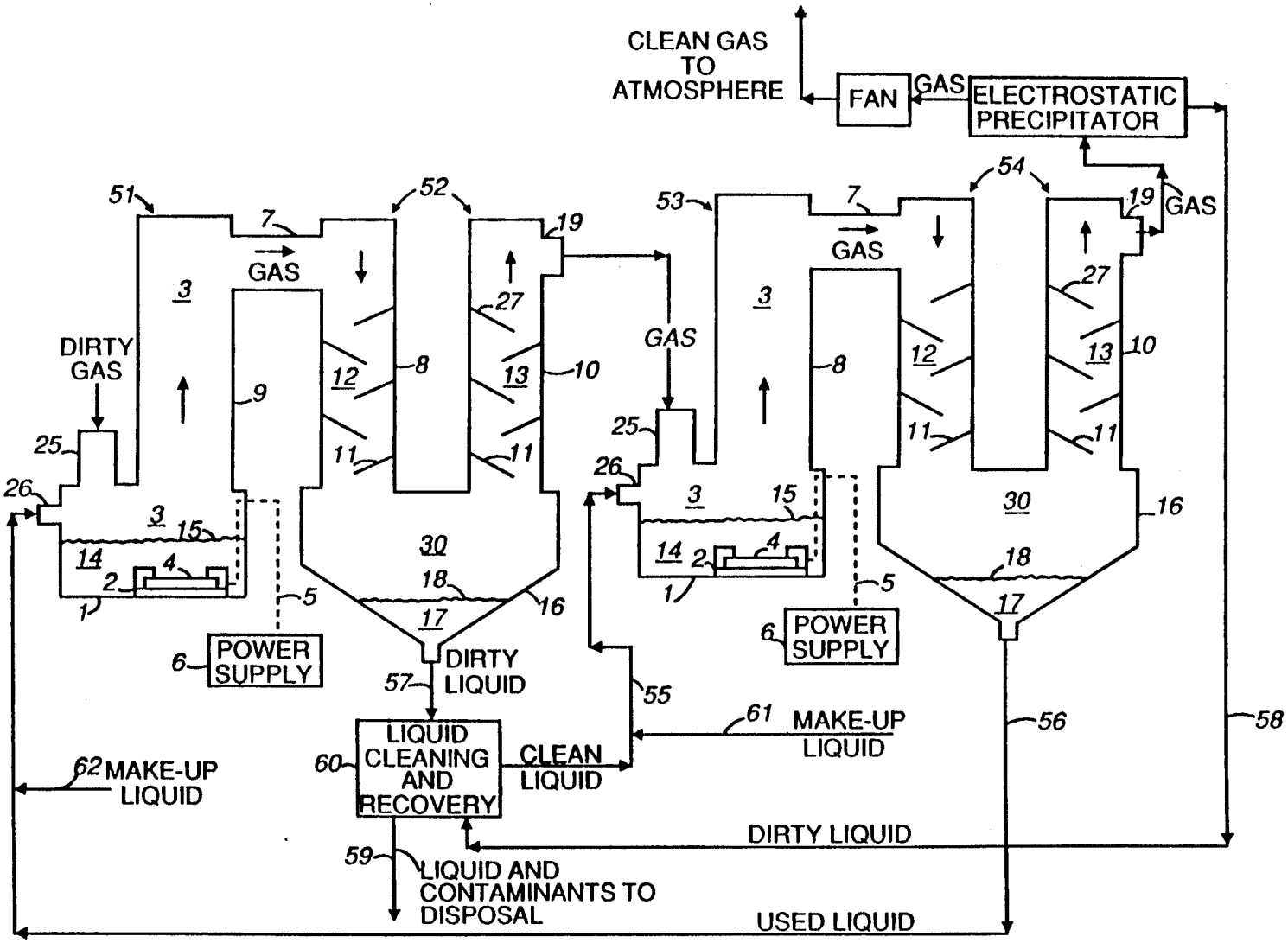
FIG. 3 is a diagram depicting an application of the invention where a gas is subjected to a two-step cleaning process and the cleaning liquid is reused.

FIG. 3 is a diagram which depicts a system in which a dirty gas is scrubbed, or cleaned, and the scrubbing liquid is recovered and reused. The system utilizes two modules such as the module which is shown in FIG. 1. Dirty gas is passed into a first reservoir and mixing zone denoted by reference no. 51, which are similar to reservoir 1 and mixing zone 3 of FIG. 1. The gas then passes into a second reservoir and separation zones denoted by reference no. 52, which are similar to reservoir 16 and separation zones 12 and 13 of FIG. 1. In order to more completely remove contaminants from the gas, it is passed into a third reservoir and mixing zone denoted by reference no. 53, which are similar to the first reservoir and mixing zone 51. The gas then passes into a fourth reservoir and separation zones 54 which are similar to the second reservoir and separation zones 52. The gas then passes into an electrostatic precipitator where droplets of mist still remaining in the gas stream are substantially removed. The clean gas than passes through a fan, which provides the pressure differential to cause the gas to flow through the entire system, and then passes into the atmosphere.

Still referring to FIG. 3, the liquid from which mist is generated in the third reservoir and mixing zone 53 is provided to the reservoir by conduits 55 and 61. This mist passes into the fourth reservoir and separation zones 54 with the gas. There, it is removed from the gaseous stream in the separation zones and transferred to the first reservoir and mixing zone 51 by means of conduit 56. This liquid, which is partially contaminated by material removed from the gas in the fourth reservoir and separation zones 54, is used again to remove material from the gas in the second reservoir and separation zones 52 and is then transported to a liquid cleaning and recovery zone 60 by conduit 57. In the liquid cleaning and recovery zone, the contaminant material is removed from the liquid and routed to an appropriate means of disposal through conduit 59. The clean liquid is than recycled to the third reservoir and mixing zone 53 via conduits 55. Make-up liquid is added to the system through conduits 61 and 62. This replaces liquid lost by various means such as leaks, liquid disposal, and any small amount of liquid remaining in the gas which is discharged to the atmosphere. Liquid removed from the gas stream in the precipitation zone flows to the liquid cleaning and recovery zone through conduit 58. In some cases, a blowdown stream (not shown) may be used to remove material from the system.

EXAMPLE I

The performance of the gas sampler was investigated by introducing a $2.5\times10^{-6}$ molar bovine serum albumin (BSA) solution having a pH of 10 into an air stream entering the sampler at 50 l/min. A small Hudson disposable nebulizer which was driven by 12 psi compressed air was used to deliver 2.3 ml in a 5 min. period at a constant flow rate. After introduction of the BSA solution, the air flow was maintained at the same value. The protein contents of the starting BSA solution and of the liquid samples recovered from the samples where determined by Bio-Rad Protein Assays (from Bio-Rad Laboratories of Richmond, Calif.). A total of 402.4 micrograms or 9844 optical density units were delivered in the 5 min. period. Liquid accumulating in the second reservoir was collected over four 5 min. sample periods starting at the same time as BSA solution introduction was started. Each sample had a volume of about 10 ml. Protein content of each sample is shown in the Table. After 10 min., 24.5% of the protein added to the air stream was collected and after 20 min., 28.4% was collected. A concentration factor may be defined as amount of protein per ml of liquid divided by amount of protein per ml of air. After 10 min., the concentration factor is $$\frac{\frac{2420}{20}}{\frac{9844}{250{,}000}} = 3073.$$

This shows that when there is a trace concentration of material in air, or in the atmosphere, a sample of the material which is of a reasonable size for analysis and characterization can be obtained.

TABLE

| Collection Period | Optical Density Units Collected | Cumulative Total O.D. Units Collected |
|---|---|---|
| 0–5 min | 1260 | 1260 |
| 5–10 min | 1160 | 2420 |
| 10–15 min | 287 | 2707 |
| 15–20 min | 96 | 2803 |

EXAMPLE II

Using the nebulizer and samples of Example I, BSA solution was nebulized into a 50 l/min. air stream in an amount sufficient to yield a concentration of 1 part per trillion of BSA in air. The liquid collected in the second reservoir was continuously passed through the analytical apparatus comprised of a fluorometer mentioned above. Within 60 seconds after addition to the air stream was started, the presence of BSA was detected.

In the experimentation, several methods of removing liquid containing the material to be collected from the gaseous stream were tried, but only the configuration of the separation zones which is described herein was successful for the materials used in the experimentation. Separation zones containing "steel wool", stacked layers of fine screens, and surfaces cooled by a chlorofluorohydrocarbon refrigerant were used, but were not suitable.

The experimental sampler was designed to handle an air flow from about 10 to about 100 l/min. Samplers and scrubbers of larger or small sizes to handle different gas flows can easily be designed. A separation zone need not be circular in cross section, but may be rectangular or any convenient shape. A mixing zone may have any configuration which promotes mixing of mist and gas; the configuration is not limited to that shown in FIG. 1, where incoming gas makes a 90 degree turn and then comes into contact with the mist and then makes another 90 degree turn. More than one piezoelectric transducer may be located in a single mist generation (first) reservoir and they may have different operating parameters, such as differing frequency and/or amplitude. There may be only one or numerous separation zones associated with a single sampler or scrubber. In a single separation zone, the number of baffles may vary from about 4 to about 20 baffles. The exact values of the above parameters and others given above depend on the characteristics of the gas being sampled (or scrubbed), the liquid used in the sampler (or scrubber), and the material to be removed from the gas.

In the experimental apparatus, the piezoelectric transducer used was a Model TU26B from TDK Co. It's frequency was fixed at $2.0\times10^6$ Hz and voltage was adjustable from 100 to 150 volts. The power requirement was very small. With the voltage set at 100 volts, a small amount of mist was made. The experimentation was done with a setting of 150 volts, which produced much more mist than 100 volts. It is expected that varying the frequency will vary the size of the mist droplets; the lower the frequency, the larger the droplet size. Droplet size was determined using a laser beam light scattering apparatus; size ranged from about 0.1 to about 10 microns. The mixing zones and separation zones may also be referred to as mixing means and separation means. The apparatus used was built at Los Alamos National Laboratory for in-house use, but laser droplet sizing apparatus is also commercially available.

What is claimed is:

1. A method of removing material from a gas comprising:

a. generating a mist from a liquid in a reservoir using a piezoelectric ultrasonic transducer located in said reservoir;

b. mixing said gas with said mist;

c. passing said mixture in a downward direction through a first separation zone having downwardly angled baffles;

d. passing, in an upward direction, the gaseous stream exiting said first separation zone through a second separation zone having downwardly angled baffles; and e. collecting liquid, which contains at least a portion of said material, at the lower ends of said separation zones.

2. The method of claim 1 where said liquid containing said material is analyzed in order to characterize said material.

3. The method of claim 1 where said material is substantially removed from liquid flowing out of said separation zones and the liquid is recycled to said reservoir.

4. The method of claim 1 where said gas is at least partially absorbed by said liquid.

5. The method of claim 1 where a chemical reaction takes place between a portion of said gas and said liquid.

6. The method of claim 1 where said piezoelectric ultrasonic transducer is operated at about $2\times10^6$ Hz.

7. The method of claim 1 where the gaseous stream exiting said second separation zone is passed through an electrostatic precipitation zone in order to remove substantially all liquid from the stream.

8. The method of claim 7 where a liquid stream recovered from said electrostatic precipitation zone is combined with the liquid in said second reservoir and the resulting liquid is analyzed.

9. Apparatus for removing material from a gas comprising:

a. a first reservoir means for adding liquid to it;

b. a piezoelectric ultrasonic transducer located in said first reservoir and control means for the transducer, where the transducer generates a mist from liquid in said reservoir;

c. a mixing means for said gas and said mist which is in communication with said first reservoir;

d. a first separation means having downwardly angled baffles and an inlet nozzle at its upper end which is in communication with said mixing means;

e. a second separation means one having downwardly angled baffles and an inlet nozzle at its lower end which is in communication with the lower end of said first separation means;

f. a second reservoir, in communication with the lower ends of said separation means so liquid containing said material can flow into the second reservoir from said separation means;

g. means for moving said gas and said mist through said mixing means and said separation zones.

10. The apparatus of claim 9 further including means to maintain a substantially constant volume of said liquid in said first reservoir.

11. The apparatus of claim 9 further including means for analyzing said material containing liquid.

12. The apparatus of claim 9 where said baffle separation means are cylindrical and said downwardly angled baffles are flat plates.

13. The apparatus of claim 9 where said downwardly angled baffles form downward facing angles with the walls of the separation means of from about 20° to about 60°.

14. The apparatus of claim 9 where from about 50% to about 80% of the horizontal area of said separation means is blocked by a baffle.

15. The apparatus of claim 9 where each separation means has from about 4 to about 20 baffles.

16. The apparatus of claim 9 further including an electrostatic precipitation means in communication with said second separation means.

17. The apparatus of claim 9 further including:

a. a third reservoir;

b. a piezoelectric ultrasonic transducer located in said third reservoir and control means for the transducer, where the transducer generates a mist from liquid in said third reservoir;

c. a second mixing means for gas and mist which is in communication with said second separation means, from which is received a gaseous stream, and also in communication with said first reservoir, from which mist is received;

d. a third separation means having downwardly angled baffles and an inlet nozzle at its upper end which is in communication with said second mixing means;

e. a fourth separation means having downwardly angled baffles and an inlet nozzle at its lower end which is in communication with the lower end of said third separation means;

f. a fourth reservoir in communication with the lower ends of said third and fourth separation means so liquid containing said material can flow into the fourth reservoir from said third and fourth separation means;

g. means for moving gas and mist through said second mixing means and said third and fourth separation means.

18. The apparatus of claim 17 further including means for providing liquid to said first and third reservoirs.

19. The apparatus of claim 17 further including means for conveying liquid and materials contained therein away from said second and fourth reservoirs.

* * * * *